US010875671B2

(12) United States Patent
Noda

(10) Patent No.: US 10,875,671 B2
(45) Date of Patent: Dec. 29, 2020

(54) BLISTER PACKAGING MACHINE

(71) Applicant: CKD Corporation, Aichi (JP)

(72) Inventor: Naohiko Noda, Aichi (JP)

(73) Assignee: CKD CORPORATION, Aichi (JP)

( * ) Notice: Subject to any disclaimer, the term of this patent is extended or adjusted under 35 U.S.C. 154(b) by 124 days.

(21) Appl. No.: 16/233,213

(22) Filed: Dec. 27, 2018

(65) Prior Publication Data

US 2019/0127094 A1 May 2, 2019

Related U.S. Application Data

(63) Continuation of application No. PCT/JP2017/004571, filed on Feb. 8, 2017.

(30) Foreign Application Priority Data

Jun. 29, 2016 (JP) ..... 2016-128579

(51) Int. Cl.
*B65B 9/04* (2006.01)
*B65B 47/02* (2006.01)
(Continued)

(52) U.S. Cl.
CPC ..... *B65B 9/045* (2013.01); *B65B 7/164* (2013.01); *B65B 47/02* (2013.01); *B65B 47/04* (2013.01);
(Continued)

(58) Field of Classification Search
CPC ..... B65B 7/164; B65B 7/26; B65B 47/00; B65B 9/04; B65B 9/045; B65B 47/02; B65B 47/04
(Continued)

(56) References Cited

U.S. PATENT DOCUMENTS 3,512,332 A * 5/1970 Klein ..... B65B 9/00 53/449
3,555,779 A * 1/1971 Nemer ..... B65B 47/00 53/374.8
(Continued)

FOREIGN PATENT DOCUMENTS

DE 102006045191 A1 * 5/2008 ..... B65B 9/045
JP 2008-297008 A 12/2008
(Continued)

OTHER PUBLICATIONS

International Preliminary Report on Patentability for corresponding International Application No. PCT/JP2017/004571 dated Jan. 10, 2019 (11 pages).
(Continued)

*Primary Examiner* — Stephen F. Gerrity
(74) *Attorney, Agent, or Firm* — Osha Liang LLP

(57) ABSTRACT

A blister packaging machine that manufactures a blister pack, wherein the blister pack comprises: a lidded container that includes a container main body and an outer lid portion; and an inner cover film attached to close the opening of the container main body, the blister packaging machine comprising: a conveyor; a molding device that executes a molding process to a strip-shaped container film and form a lidded container-corresponding part corresponding to the lidded container; a placing device that is disposed downstream of the molding device and places the article in a container part; a sealing device that is disposed downstream of the placing device and attaches the inner cover film to close an opening of the container part; and a punching device that is disposed downstream of the sealing device and punches out the lidded container-corresponding part along with the inner cover film to produce the blister pack.

4 Claims, 8 Drawing Sheets

(51) Int. Cl.

| | |
|---|---|
| ***B65B 47/04*** | (2006.01) |
| ***B65B 7/16*** | (2006.01) |
| ***B65D 51/20*** | (2006.01) |
| ***B65D 75/36*** | (2006.01) |
| ***B65D 43/16*** | (2006.01) |
| *B65B 43/16* | (2006.01) |
| *A61J 1/03* | (2006.01) |

(52) U.S. Cl.
CPC ..... *B65D 43/163* (2013.01); *B65D 51/20* (2013.01); *B65D 75/367* (2013.01); *A61J 1/035* (2013.01); *B65D 2251/0021* (2013.01); *B65D 2251/0093* (2013.01); *B65D 2585/56* (2013.01)

(58) Field of Classification Search
USPC ..... 53/453, 559
See application file for complete search history.

(56) References Cited

U.S. PATENT DOCUMENTS

| | | | | |
|---|---|---|---|---|
| 5,201,163 | A * | 4/1993 | Reil et al. | B65B 9/042 53/410 |
| 5,369,937 | A * | 12/1994 | Logothetis | B65B 9/045 53/122 |
| 6,282,870 | B1 * | 9/2001 | Robache | B65B 9/00 53/377.6 |
| 2007/0277658 | A1 * | 12/2007 | Martelli | B65B 9/045 83/27 |
| 2013/0118117 | A1 * | 5/2013 | Grobbel | B65B 7/164 53/329.2 |
| 2013/0199698 | A1 * | 8/2013 | Payne et al. | B65B 7/164 156/69 |
| 2015/0367566 | A1 * | 12/2015 | Schwab et al. | B65B 9/042 53/453 |
| 2016/0194101 | A1 * | 7/2016 | Palumbo | B65B 47/04 53/433 |

FOREIGN PATENT DOCUMENTS

| | | | |
|---|---|---|---|
| JP | 2013-159367 | A | 8/2013 |
| JP | 2015-182781 | A | 10/2015 |
| JP | 2016-94207 | A | 5/2016 |
| WO | 2014/180823 | A1 | 11/2014 |

OTHER PUBLICATIONS

International Search Report issued in corresponding International Application No. PCT/JP2017/004571 dated Mar. 21, 2017 (5 pages).

* cited by examiner

BLISTER PACKAGING MACHINE

BACKGROUND

Technical Field

The present invention relates to a blister packaging machine configured to manufacture a blister pack provided with a lidded container that includes a container main body configured to store a predetermined article therein and an outer lid portion integrally formed with the container main body, and an inner cover film mounted to the container main body.

Description of Related Art

A known configuration of a blister pack to place any of various articles (for example, a food product or a medical product) therein is a lidded container including a container main body configured to place the article therein and an outer lid portion formed integrally with the container main body and configured to open and close an opening of the container main body. The blister pack may include an inner cover film (seal cover) that is mounted to close the opening of the container main body, in order to seal the article placed in the container main body (as described in, for example, Patent Literature 1).

A proposed configuration of a blister packaging machine used to manufacture such a blister pack includes a molding unit configured to cause a strip-shaped container film subject to a molding process and thereby form a part corresponding to the lidded container (lidded container-corresponding part); a conveyor unit configured to convey the container film in such a state that respective edges of the container film after molding are clamped by the conveyor unit; a placing unit configured to place the article into a part of the conveyed container film corresponding to the container main body; and a cutting unit configured to cut out the lidded container from the container film (as described in, for example, Patent Literature 2). The cutting unit is configured to cut the container film with cutting lines or the like formed in a direction (lateral direction) perpendicular to a longitudinal direction, along the longitudinal direction (lengthwise direction) and is comprised of, for example, rotary blades arranged to place the container film therebetween in the vertical direction. For example, the inner cover film after placing of the article may be mounted to the container film prior to cutting by the cutting unit.

In the blister packaging machine described above, the container film may be linearly cut by the cutting unit. By taking into account the safety aspect, when the corners of the blister pack (lidded container) is to be in a rounded curved shape, there is a need to punch regions corresponding to the corners to have the curved shape, prior to cutting by the cutting unit.

CITATION LIST

Patent Literature

PTL 1: JP 2015-182781A

PTL 2: JP 2008-297008A

The punching process is, however, likely to cause a large number of scraps of the container film (in the case where the inner cover film is punched along with the container film, scraps of the container film and the inner cover film) that are separated from one another. This may cause contamination of a product including the produced blister pack by the scraps. There is also a need to execute punching separately from cutting by the cutting unit. This increases the number of manufacturing processes and is likely to decrease the productivity.

A configuration of producing the blister pack only by cutting by the cutting unit with a view to preventing contamination by the scraps and increasing the productivity, however, provides a linear outer edge portion of the blister pack (or more specifically, the lidded container). This reduces the flexibility of design with regard to the outer edge shape of the blister pack. A possible measure may employ a trimming process of the outer edge portion of the blister pack to form the outer edge shape of the blister pack to a desired shape. This measure is, however, likely to cause contamination by the scraps and decrease the productivity.

SUMMARY

A blister packaging machine according to one or more embodiments of the present invention enhances the flexibility of design with regard to an outer edge shape of a blister pack and more reliably prevents contamination of a product including the blister pack by scrap.

Embodiments of the present invention are described. Functions and advantageous effects according to one or more embodiments of the present invention are also described as appropriate.

A blister packaging machine according to one or more embodiments of the present invention is configured to manufacture a blister pack. The blister pack comprises a lidded container that includes a container main body configured to place an article therein and an outer lid portion integrally formed with the container main body and that is configured such that an opening of the container main body is opened and closed by the outer lid portion; and an inner cover film that is mounted to the container main body, such as to close the opening of the container main body which the article is placed in.

The blister packaging machine comprises a molding unit configured to execute a molding process of a conveyed, strip-shaped container film and form a lidded container-corresponding part corresponding to the lidded container; a placing unit provided downstream of the molding unit and configured to place the article into a container-corresponding part that is a region of the lidded container-corresponding part corresponding to the container main body; a mounting unit provided downstream of the placing unit and configured to mount the inner cover film to at least the container-corresponding part such as to close an opening of the container-corresponding part; and a punching unit provided downstream of the mounting unit and configured to punch the lidded container-corresponding part of the container film, along with the inner cover film and thereby produce the blister pack. A scrap portion of the container film and the inner cover film that remains after punching by the punching unit is made continuous along the conveying direction.

According to the embodiments described above, the blister pack is produced by punching. This configuration enhances the flexibility of design with regard to an outer edge shape of the blister pack (or more specifically, the lidded container). In the process of producing the blister pack, the outer edge shape of the blister pack is formed to a desired shape by only punching. This eliminates a need to separately execute a process of rounding the corners and the like and thereby increases the productivity.

Additionally, according to the embodiments described above, the scrap portion remaining after punching is made continuous along the conveying direction of the container film. Accordingly, the configuration of the embodiments described above prevents a large number of scraps from being separated from one another. As a result, this more reliably prevents contamination of a product including the blister pack by the scrap portion.

In the blister packaging machine according to the embodiments described above, the molding unit may be configured to form the container-corresponding parts in the container film, such that the container-corresponding parts are arrayed along the conveying direction. The mounting unit may be configured to successively mount the inner cover film in a strip shape that is extended along the conveying direction, to the container-corresponding portions arrayed along the conveying direction. A container scrap portion of the container film that remains after punching by the punching unit may be made continuous along the conveying direction. An inner cover scrap portion of the inner cover film that remains after punching by the punching unit may be made continuous along the conveying direction on only one edge side in a width direction.

According to the embodiments described above, the scrap of the inner cover film remaining after punching (inner cover scrap portion) is made continuous along the conveying direction on only the one edge side in the width direction. This prevents a large amount of the inner cover scrap portion from being discharged. As a result, this effectively suppresses an increase in manufacturing cost.

In the blister packaging machine according to the embodiments described above, the mounting unit may be configured to mount the inner cover film to the container film, such that a region of the container film that provides the container scrap portion and a region of the inner cover film that provides the inner cover scrap portion are not mounted to each other.

According to the embodiments described above, the inner cover scrap portion is made continuous along the conveying direction and is not mounted to the scrap of the container film remaining after punching (container scrap portion). This enables only the inner cover scrap portion to be promptly wound and collected. This accordingly allows for the higher-speed production and further increases the productivity.

Furthermore, this configuration facilitates the container scrap portion and the inner cover scrap portion to be collected separately. This enhances the convenience with regard to various processes after the collection.

In the blister packaging machine according to the embodiments described above, the molding unit may be configured to form the container-corresponding parts at intervals along the conveying direction in the container film and to form scrap mounting portions in regions located between the respective container-containing parts in the container film to be flush in a height direction with a region of the container-corresponding part which the inner cover film is mounted to. The mounting unit may be configured to successively mount the inner cover film in a strip shape to the container-corresponding parts and the scrap mounting portions arranged alternately along the conveying direction. A container scrap portion of the container film that remains after punching by the punching unit may be made continuous along the conveying direction. The scrap mounting portions may be located in the container scrap portion. An inner cover scrap portion of the inner cover film that remains after punching by the punching unit may be mounted to the scrap mounting portion.

According to the embodiments described above, the inner cover scrap portion is mounted to the scrap mounting portions provided in the container scrap portion that is made continuous along the conveying direction. This more reliably prevents the inner cover scrap portions from being separated from one another and thus more effectively prevents contamination of the product by the scrap portion.

In the blister packaging machine according to the embodiments described above, a width of the strip-shaped inner cover film along a direction perpendicular to the conveying direction may be equal to a width of a region of the container-corresponding part which the inner cover film is mounted to, along the direction perpendicular to the conveying direction.

The term "equal to" is not limited to strictly equal to but includes the case where there is a slight difference (for example, about several mm).

The configuration of the embodiments described above reduces the discharged amount of the inner cover scrap portion and effectively suppresses an increase in manufacturing cost.

DETAILED DESCRIPTION OF EMBODIMENTS

The following describes embodiments with reference to drawings.

Figure 1:
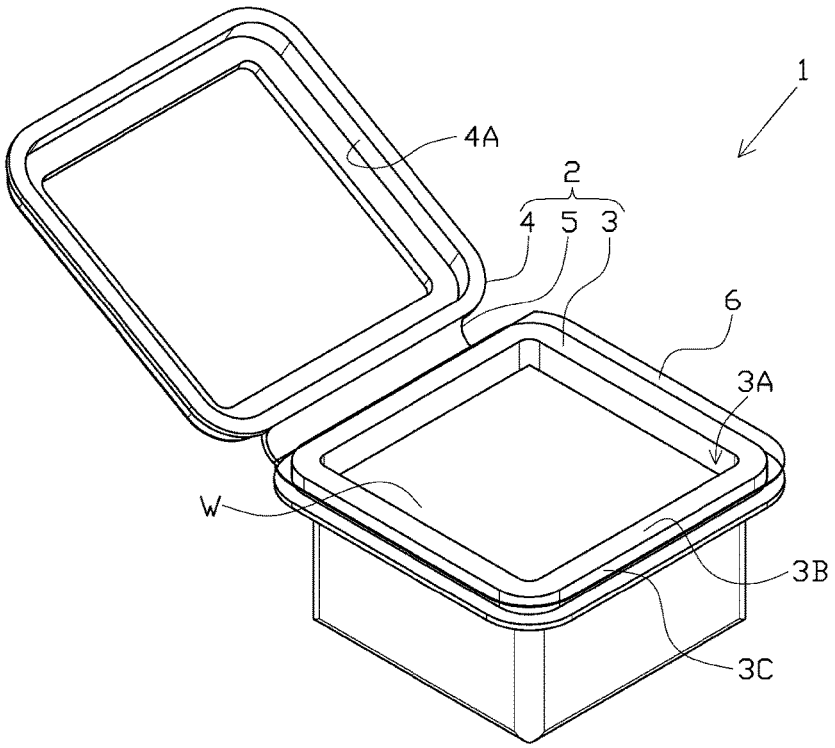
FIG. 1 is a perspective view illustrating a blister pack according to one or more embodiments of the present invention.
Figure 2:
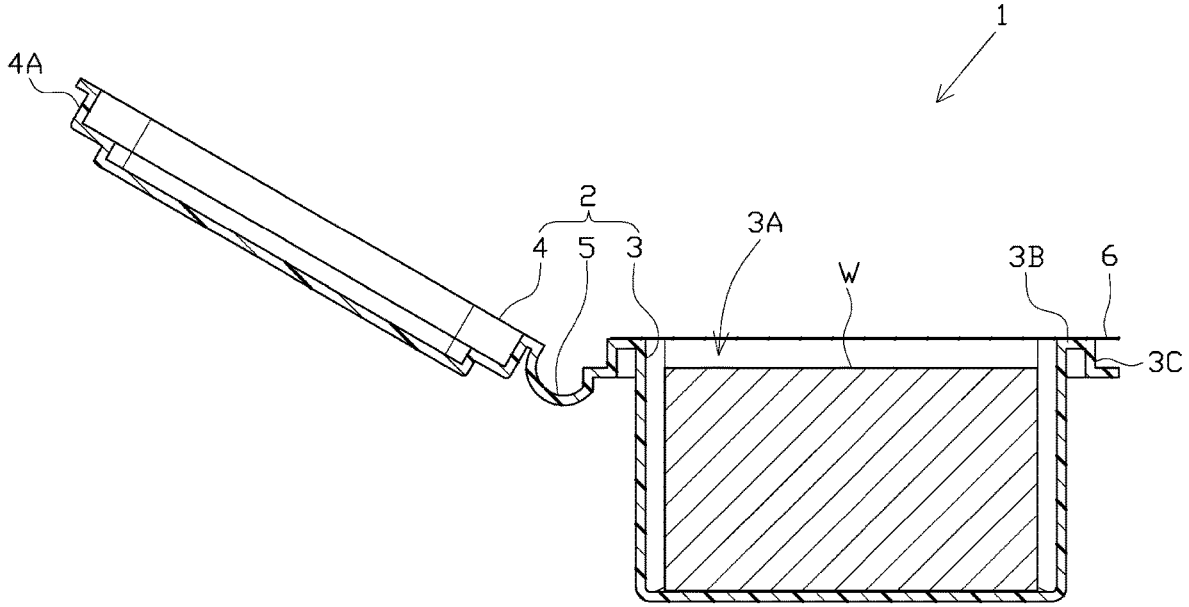
FIG. 2 is a sectional view illustrating the blister pack according to one or more embodiments of the present invention.

As shown in FIG. 1 and FIG. 2, a blister pack 1 includes a lidded container 2 and an inner cover film 6. As a matter of convenience, the lidded container 2 and the inner cover film 6 in the respective drawings are illustrated to be thicker than the actual wall thickness.

The lidded container 2 is made of a thermoplastic resin material, such as PP (polypropylene), PVC (polyvinyl chloride) or PE (polyethylene). the lidded container 2 includes a container main body 3 having a storage space 3A which a predetermined article "(for example, a food product or a medical product) is stored in, an outer lid portion 4 integrally formed with the container main body 3, and a hinge portion 5 in a curved sectional shape configured to couple the respective portions 3 and 4 with each other. The outer lid portion 4 is configured to be rotatable relative to the container main body 3 about the hinge portion 5 as a rotating shaft. The container main body 3 has an opening configured to be opened and closed by the outer lid portion 4.

The container main body 3 includes a ring-shaped sealed portion 3B that is formed to be extended outward from an opening edge of the storage space 3A, and an inner fit portion 3C that is suspended from an outermost circumference of the sealed portion 3B. The outer lid portion 4 includes a ring-shaped outer fit portion 4A having a shape corresponding to the shape of the inner fit portion 3C. In the case of closing the opening of the container main body 3 by the outer lid portion 4, the outer fit portion 4A is fit on an outer circumference of the inner fit portion 3C. This configuration firmly maintains the closing state.

The inner cover film 6 is made of a thermoplastic resin that is compatible with the lidded container 2 and is configured to be transparent or translucent according to one or more embodiments of the present invention. The inner cover film 6 is mounted to the sealed portion 3B, such as to close the opening of the container main body 3.

The following describes the configuration of a blister packaging machine 10 used to manufacture the blister pack 1 described above.

Figure 3:
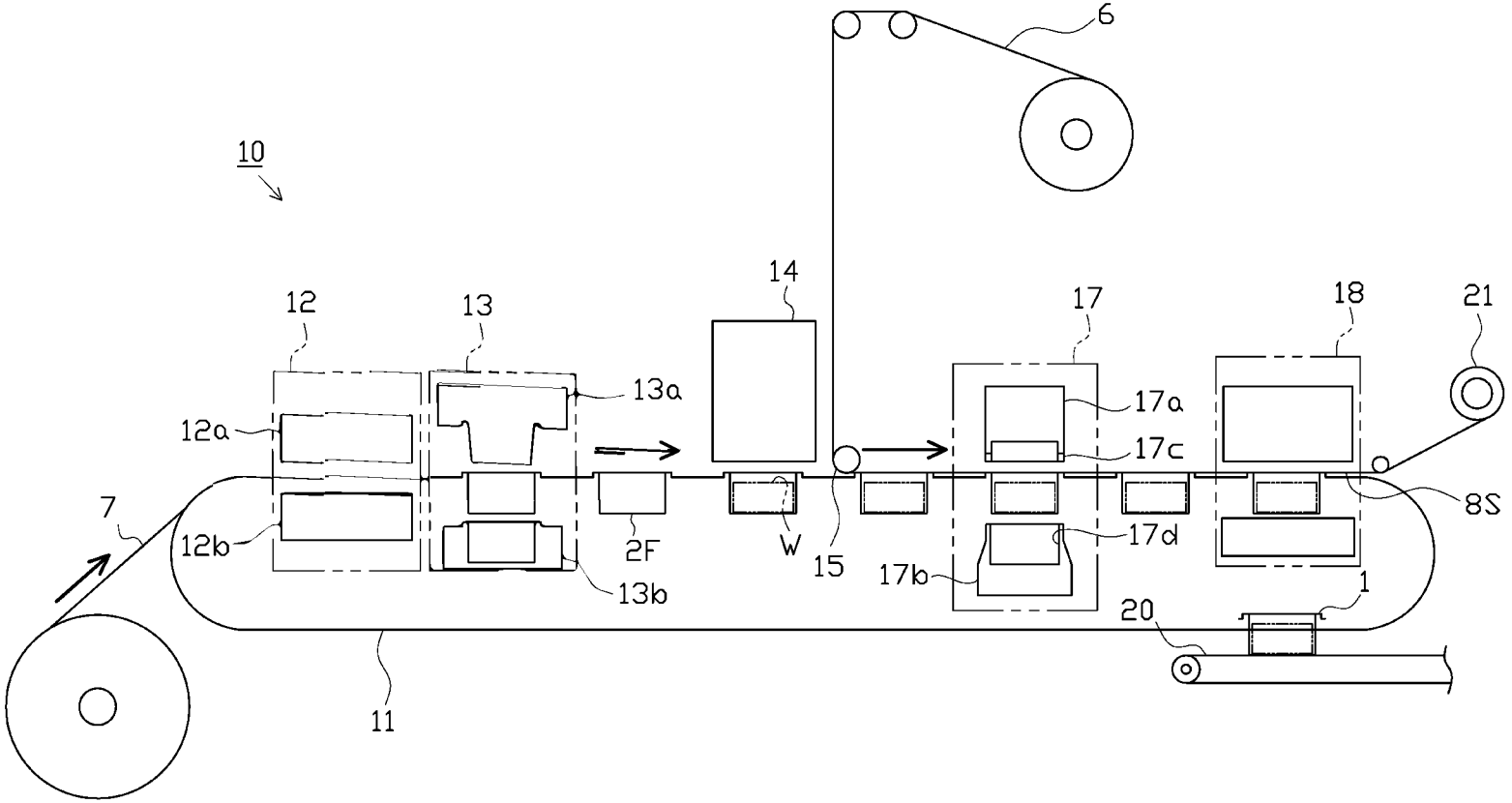
FIG. 3 is a diagram illustrating the schematic configuration of a blister packaging machine according to one or more embodiments of the present invention.

As shown in FIG. 3, in the blister packaging machine 10, a strip-shaped container film 7 drawn out from a film roll is intermittently conveyed to downstream by a predetermined conveyor 11 (for example, chain clipped conveyor). The container film 7 is a material of the lidded container 2.

A heating device 12 and a forming device 13 are provided on the downstream side of the film roll of the container film 7. The heating device 12 and the forming device 13 constitute the molding unit.

The heating device 12 includes an upper mold 12*a* and a lower mold 12*b* placed vertically across the container film 7 and is configured to partly heat a forming area of the lidded container 2 in the container film 7.

Figure 4:
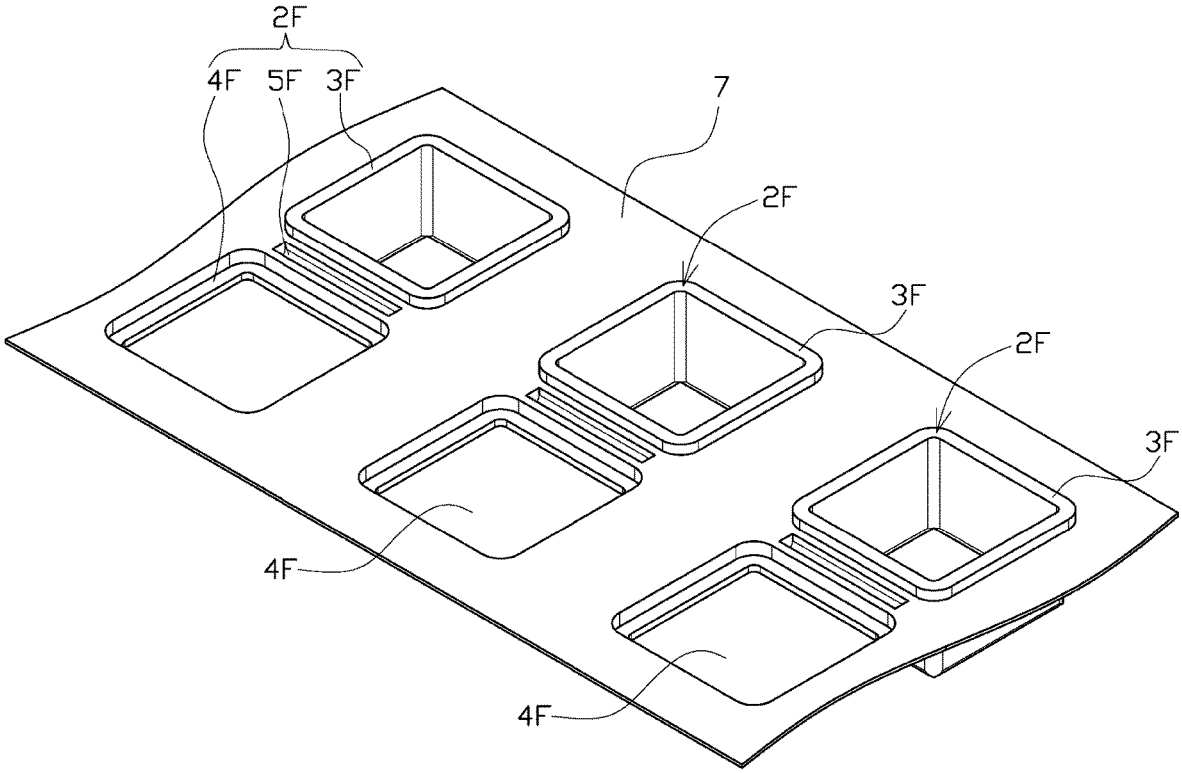
FIG. 4 is a perspective view illustrating a container film with lidded container-corresponding parts formed therein according to one or more embodiments of the present invention.

The forming device 13 includes an upper mold 13*a* that is formed in a shape approximately similar to the shape of the lidded container 2 and has a small plug, and a lower mold 13*b* that has concavity and convexity corresponding to the shape of the lidded container 2. After the container film 7 is heated to be relatively soft by the heating device 12, a lidded container-corresponding part 2F corresponding to the lidded container 2 is formed at a predetermined position of the container film 7 (as shown in FIG. 4) by the upper mold 13*a* and the lower mold 13*b*. The lidded container-corresponding part 2F includes a container-corresponding part 3F corresponding to the container main body 3, an outer lid-corresponding part 4F corresponding to the outer lid portion 4, and a hinge-corresponding part 5F corresponding to the hinge portion 5.

Formation of the lidded container-corresponding part 2F is executed during an interval between conveying operations of the container film 7. According to one or more embodiments of the present invention, the container-corresponding parts 3F arrayed along a conveying direction of the container film 7 are formed in the container film 7 by the forming device 13.

A placing device 14 serving as the placing unit is provided on the downstream side of the forming device 13. The placing device 14 serves to place the article W into a space of the container-corresponding part 3F corresponding to the storage space 3A.

A film roll of the inner cover film 6 formed in a strip shape is wound in a roll and is arranged separately from the container film 7. The inner cover film 6 drawn out from the film roll is guided to a receiving roller 15 that is provided on the downstream side of the placing device 14. The inner cover film 6 guided to the receiving roller 15 is extended along the conveying direction of the container film 7 and is laid over the container film 7, such as to close the opening of the container-corresponding part 3F.

Figure 5:
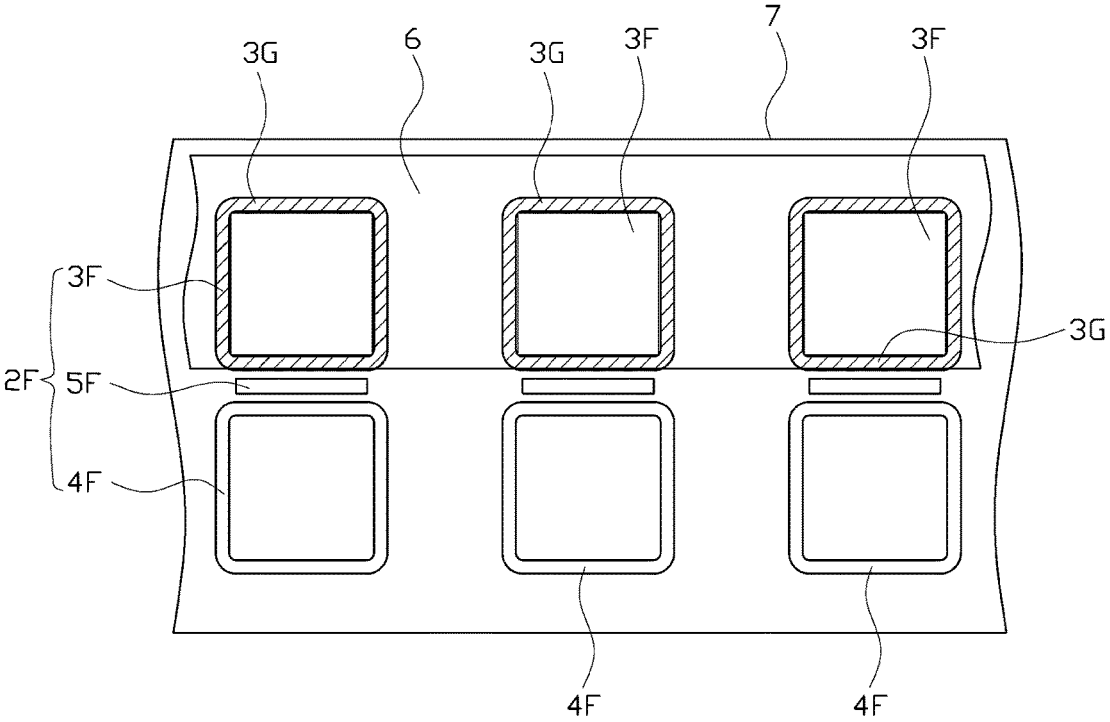
FIG. 5 is a plan view illustrating an inner cover film laid over the container film according to one or more embodiments of the present invention.

According to one or more embodiments of the present invention, the width of the inner cover film 6 along a direction perpendicular to the conveying direction of the container film 7 is larger than the width of a sealed portion-corresponding part 3G (hatched area filled with slant lines in FIG. 5) along the direction perpendicular to the conveying direction, which is a section of the container-corresponding part 3F corresponding to the sealed portion 3B. In the state that the inner cover film 6 is laid over the container film 7, one end in the width direction of the inner cover film 6 is protruded from the sealed portion-corresponding part 3G toward one end in the width direction of the container film 7. The other end in the width direction of the inner cover film 6 is, on the other hand, substantially overlapped with an outer edge of the sealed portion-corresponding part 3G.

Referring back to FIG. 3, a sealing device 17 serving as the mounting unit is provided on the downstream side of the receiving roller 15. The sealing device 17 includes an upper mold 17*a* and a lower mold 17*b*.

The upper mold 17*a* is placed above conveyance paths of the respective films 6 and 7 and is vertically movable by a non-illustrated driving unit. The upper mold 17*a* includes a heating portion 17*c* that is formed in a shape corresponding to the sealed portion 3B and is configured to generate heat by a non-illustrated heater or the like.

The lower mold 17*b* includes a recessed portion 17*d* formed to place therein a downward protruded portion of the lidded container-corresponding part 2F and is vertically movable by a non-illustrated driving unit. A flat plane of the lower mold 17*b* that is extended from an opening of the recessed portion 17*d* toward the outer circumference serves as a pressing surface and configured such that the container film 7 and the inner cover film 6 are placed between this flat plane and the heating portion 17*c* of the upper mold 17*a* described above.

In the sealing device 17, the upper mold a and the lower mold 17*b* approach the container film 7 and the inner cover film 6, so that the sealed portion-corresponding part 3G of the container-corresponding part 3F and the inner cover film 6 are placed between the heating portion 17*c* and the flat plane of the lower mold 17*b* described above. As a result, the inner cover film 6 is mounted (heat-sealed) to the sealed portion-corresponding part 3G to close the opening of the container-corresponding part 3F.

According to one or more embodiments of the present invention, the sealing device 17 is configured to mount the inner cover film 6 only to the sealed portion-corresponding part 3G of the container-corresponding part 3F. More specifically, the sealing device 17 is configured to mount the inner cover film 6 to the container film 7, such that a portion of the container film 7 as a container scrap portion 7S described later and a portion of the inner cover film 6 as an inner cover scrap portion 6S described later are not mounted to each other. Mounting of the inner cover film 6 is executed during an interval between conveying operations of the container film 7. The inner cover film 6 is sequentially mounted to the container-corresponding parts 3F by the sealing device 17.

A punching device 18 as a punching unit is provided on the downstream side of the sealing device 17. The punching device 17 includes a non-illustrated die-cutting punch in a shape corresponding to the outer edge shape of the lidded container 2. The blister pack 1 is produced by punching the lidded container-corresponding part 2F of the container film 7 along with the inner cover film 6 by the die-cutting punch. According to one or more embodiments of the present invention, the shape of the die-cutting punch is set to provide rounded corners in the outer edge of the lidded container 2.

A conveyor 20 is provided below the punching device 18. The punched blister pack 1 is transferred to downstream by the conveyor 20. During the transfer or after the transfer, the outer lid portion 4 is closed by a predetermined closing device (not shown).

Figure 6:
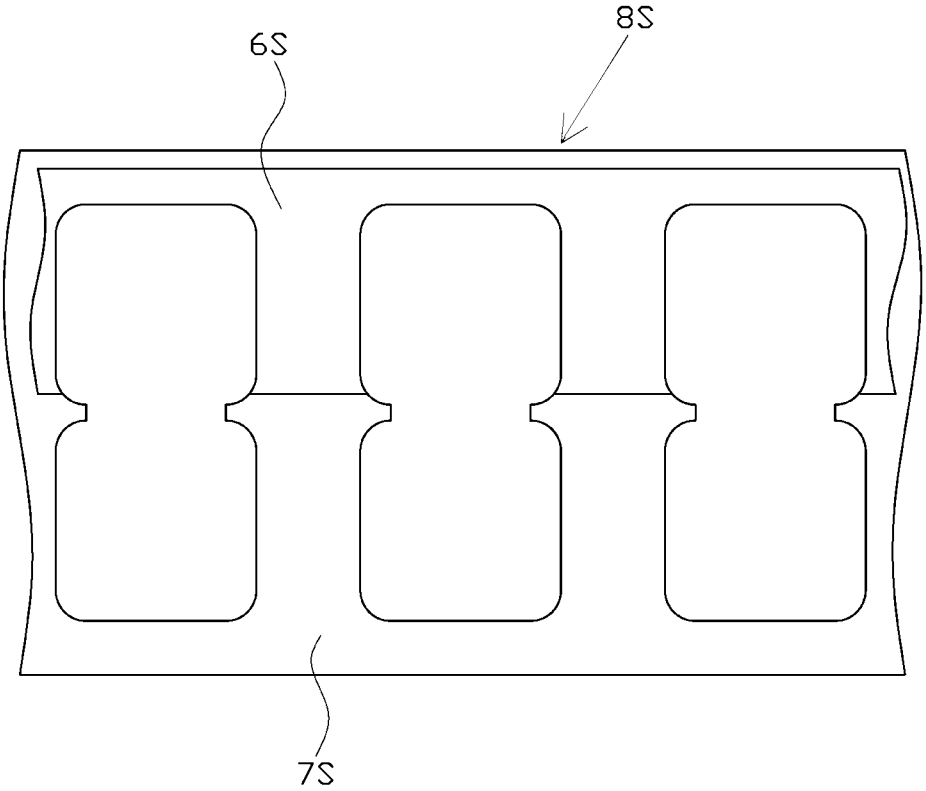
FIG. 6 is a plan view illustrating a scrap portion remaining after punching according to one or more embodiments of the present invention.

After punching of the inner cover film 6 and the container film 7, a scrap portion 8S remains as shown in FIG. 6. The scrap portion 8S includes a container scrap portion 7S that is part of the container film 7 remaining after punching, and an inner cover scrap portion 6S that is part of the inner cover film 6 remaining after punching. The container scrap portion 7S and the inner cover scrap portion 6S are respectively made continuous along the conveying direction of the container film 7. Accordingly, the scrap portion 8S is made continuous along the conveying direction of the container film 7. This prevents a large number of scraps from being separated from one another. According to one or more embodiments of the present invention, the inner cover scrap portion 6S is made continuous along the conveying direction on only one edge side in the width direction.

Furthermore, the inner cover film 6 is mounted to only the sealed portion-corresponding parts 3G by the sealing device 17 as described above. The container scrap portion 7S and the inner cover scrap portion 6S are not mounted to each other (are separated from each other).

The inner cover scrap portion 6S is wound to be collected by a collecting device 21 provided downstream of the punching device 18.

The container scrap portion 7S is, on the other hand, conveyed to a non-illustrated cutting device provided downstream of the punching device 18, is cut into predetermined dimensions by the cutting device, and is accumulated in a non-illustrated predetermined scrap hopper.

As described above in detail, according to one or more embodiments of the present invention, the blister pack 1 is produced by punching. This enhances the flexibility of design with regard to the outer edge shape of the blister pack 1 (lidded container 2). In the process of producing the blister pack 1, the outer edge shape of the blister pack 1 is formed to a desired shape by only punching. This eliminates a need to separately execute a process of rounding the corners and the like and thereby increases the productivity.

Additionally, the scrap portion 8S remaining after punching is made continuous along the conveying direction of the container film 7. This prevents a large number of scraps from being separated from one another. As a result, this more reliably prevents contamination of a product including the blister pack 1 by the scrap portion 8S.

The inner cover scrap portion 6S is made continuous along the conveying direction on only the one edge side in the width direction. This prevents a large amount of the inner cover scrap portion 6S from being discharged. As a result, this effectively suppresses an increase in manufacturing cost.

Additionally, the inner cover scrap portion 6S is not mounted to (is separated from) the container scrap portion 7S. This enables the inner cover scrap portion 6S to be promptly wound and collected. As a result, this allows for the higher-speed production and further increases the productivity.

Furthermore, this configuration enables the container scrap portion 7S and the inner cover scrap portion 6S to be collected separately. This enhances the convenience with regard to various processes after the collection (for example, waste sorting prior to disposal).

The following describes one or more embodiments of the present invention with focusing on differences from the embodiments described above.

Figure 7:
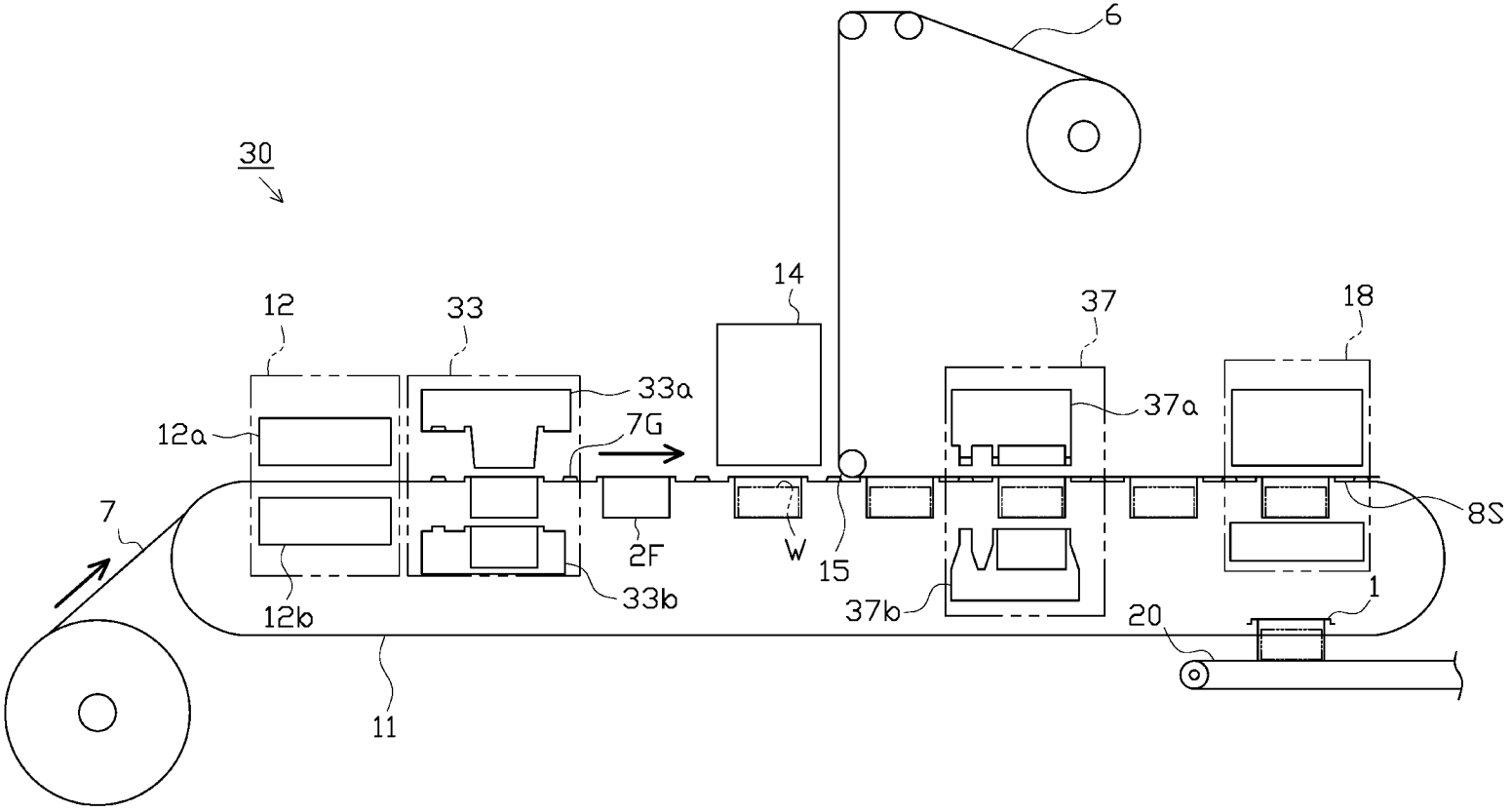
FIG. 7 is a diagram illustrating the schematic configuration of a blister packaging machine according to one or more embodiments of the present invention.
Figure 8:
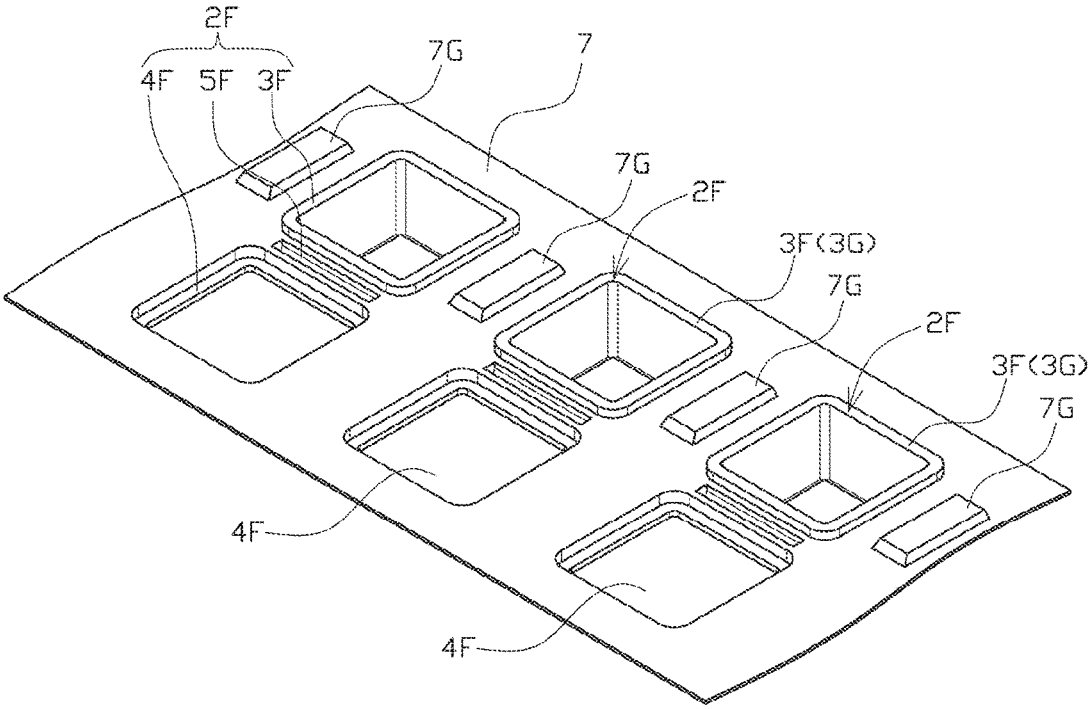
FIG. 8 is a perspective view illustrating a container film with lidded container-corresponding parts and scrap mounting portions formed therein according to one or more embodiments of the present invention.

According to the above embodiments, the blister packaging machine 10 is configured to form the lidded container-corresponding parts 2F in the container film 7. According to one or more embodiments of the present invention, on the other hand, as shown in FIG. 7 and FIG. 8, a blister packaging machine 30 is configured to form scrap mounting portions 7G along with lidded container-corresponding parts 2F in a container film 7. The scrap mounting portion 7G is formed in a truncated quadrangular pyramid shape and is configured to have an upper end face that is flush with a sealed portion-corresponding part 3G in the height direction. Container-corresponding parts 3F and the scrap mounting portions 7G are provided to be alternately arranged along the conveying direction of the container film 7.

With a view to forming such scrap mounting portions 7G, a forming device 33 according to one or more embodiments of the present invention includes an upper mold 33*a* having a concave structure corresponding to the shape of the scrap mounting portion 7G and a lower mold 33*b* having a convex structure corresponding to the shape of the scrap mounting portion 7G. After areas of the container film 7 for forming a lidded container 2 and the scrap mounting portion 7G are heated to be relatively soft by a heating device 12, the lidded container-corresponding part 2F and the scrap mounting portion 7G are formed in the container film 7 by the upper mold 33*a* and the lower mold 33*b*. According to one or more embodiments of the present invention, the heating device 12 and the forming device 33 constitute the molding unit.

According to one or more embodiments of the present invention, the forming device 33 forms the container-corresponding parts 3F at intervals in the container film 7 along the conveying direction of the container film 7, while forming the scrap mounting portions 7G in regions located between the respective container-corresponding parts 3F in the container film 7.

Figure 9:
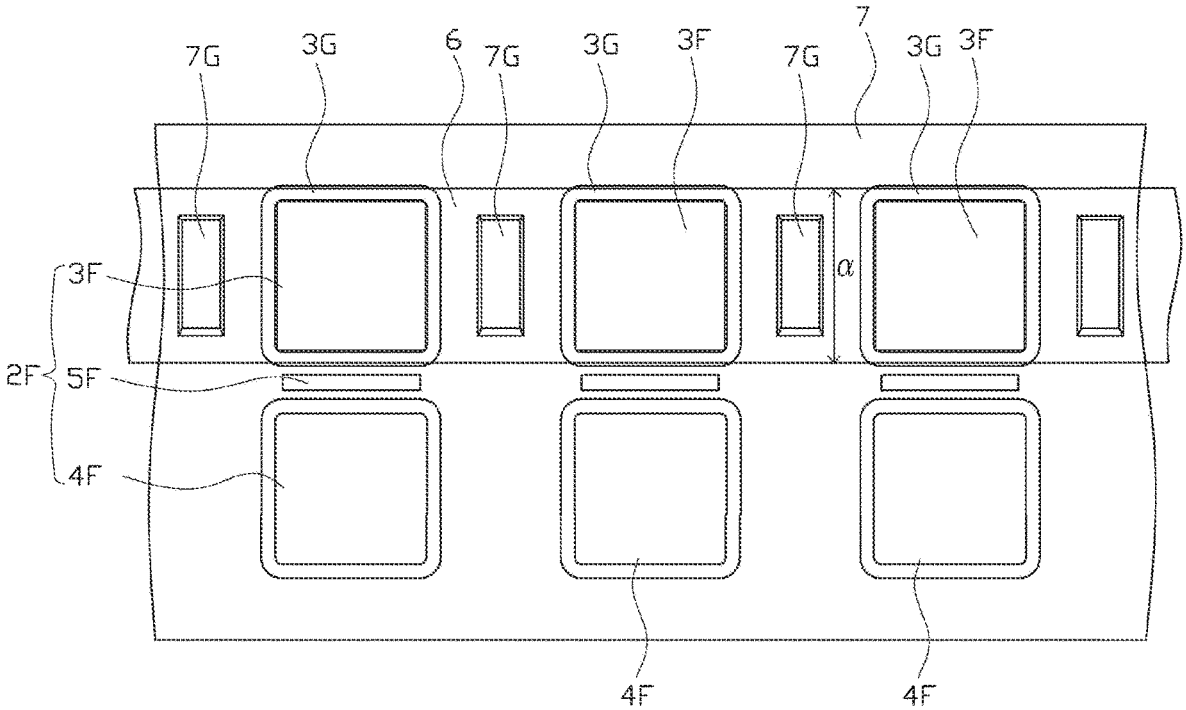
FIG. 9 is a plan view illustrating an inner cover film laid over the container film according to one or more embodiments of the present invention.

Furthermore, according to one or more embodiments of the present invention, an inner cover film 6 guided to a receiving roller 15 has a narrower width than the inner cover film 6 of the embodiments described above. More specifically, according to one or more embodiments of the present invention, the width $\alpha$ of the inner cover film 6 along a direction perpendicular to the conveying direction of the container film 7 is equal to the width of the sealed portion-corresponding part 3G along the direction perpendicular to the conveying direction (as shown in FIG. 9). Accordingly, when the inner cover film 6 is laid over the container film 7, one edge in the width direction and the other edge in the width direction of the inner cover film 6 are substantially overlapped with the outer edge of the sealed portion-corresponding part 3G.

According to one or more embodiments of the present invention, a sealing device 37 as the mounting unit sequentially mounts the strip-shaped inner cover film 6 to the container-corresponding parts 3F (sealed portion-corresponding parts 3G) and the scrap mounting portions 7G arranged alternately along the conveying direction of the container film 7. The sealing device 37 includes an upper mold 37*a* having a heating portion for scrap corresponding to the scrap mounting portion 7G, and a lower mold 37*b* having a pressing surface configured such that the scrap mounting portions 7G and the inner cover film 6 are placed between this pressing surface and the heating portion for scrap. The scrap mounting portions 7G and the inner cover film 6 are placed between and heated by the heating portion for scrap and the pressing surface of the lower mold 37*b*, so that the inner cover film 6 is mounted (heat-sealed) to the scrap mounting portions 7G.

Figure 10:
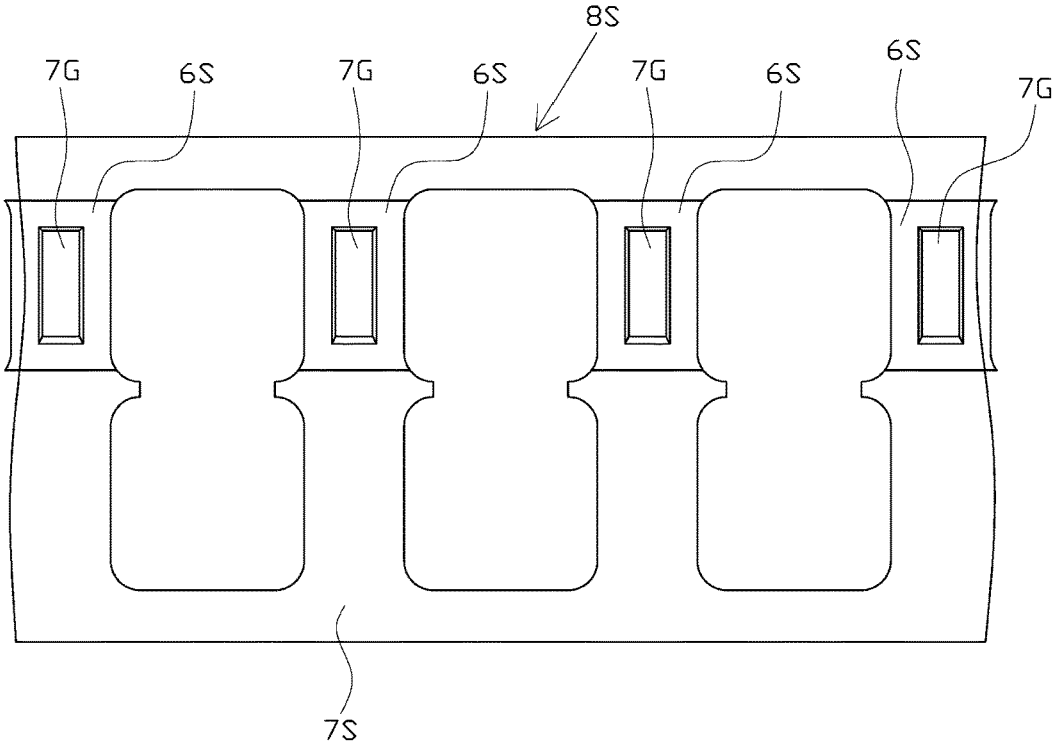
FIG. 10 is a plan view illustrating a scrap portion remaining after punching according to one or more embodiments of the present invention.

As shown in FIG. 10, with regard to a scrap portion 8S remaining after punching of the inner cover film 6 and the container film 7, a container scrap portion 7S is made continuous along the conveying direction of the container film 7 like the above embodiments. Unlike the above embodiments, however, an inner cover scrap portion 6S is divided along the conveying direction, and respective fragments of the divided inner cover scrap portion 6S are mounted to the scrap mounting portions 7G. Like the above embodiments, the scrap portion 8S is accordingly made continuous along the conveying direction of the container film 7. This prevents a large number of scraps from being separated from one another.

According to one or more embodiments of the present invention, the scrap portion 8S may be, for example, cut into predetermined dimensions by the cutting device and accumulated in the scrap hopper.

As described above, one or more embodiments of the present invention basically have similar functions and advantageous effects to those of the embodiments described above.

Additionally, the inner cover scrap portion 6S is mounted to the scrap mounting portions 7G provided in the container scrap portion 7S. This more reliably prevents the inner cover scrap portions 6S from being separated from one another and thus more effectively prevents contamination of the product by the scrap portion 8S.

The width of the strip-shaped inner cover film 6 is equal to the width of the regions of the container-corresponding parts 3F which the inner cover film 6 is mounted to (i.e., the sealed portion-corresponding parts 3G). This configuration reduces the discharged amount of the inner cover scrap portion 6S and effectively suppresses an increase in manufacturing cost.

The present invention is not limited to the description of the above embodiments but may be implemented, for example, by configurations described below. The present invention may also be naturally implemented by applications and modifications other than those illustrated below.

Figure 11:
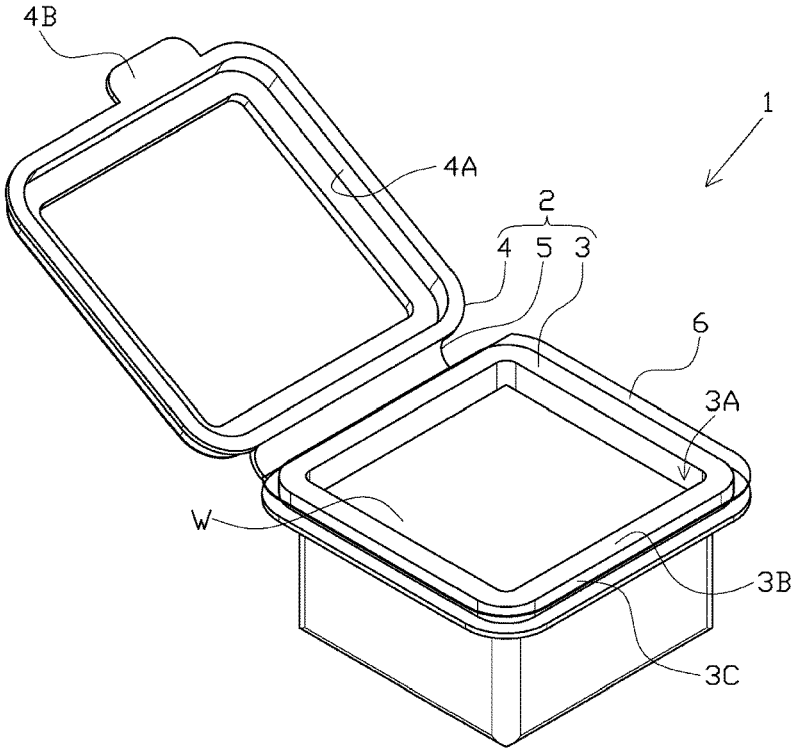
FIG. 11 is a perspective view illustrating a blister pack according to one or more embodiments of the present invention.

(a) The shape and the configuration of the blister pack 1 described in the above embodiments are only illustrative and may be changed or modified appropriately. For example, as shown in FIG. 11, part of an outer edge of an outer lid portion 4 may be protruded to form a grip 4B that is usable to rotate the outer lid portion 4 (to open and close the opening of a container main body 3). The outer edge shape of the lidded container 2 is formed to the desired shape by only punching. Even when the lidded container 2 has a relatively complicated outer edge shape, this configuration ensures the good productivity.

(b) The materials and the specifications of the lidded containers 2 (container film 7) and the inner cover film 6 described in the above embodiments are only illustrative. These materials and the like may be changed or modified appropriately.

Figure 12:
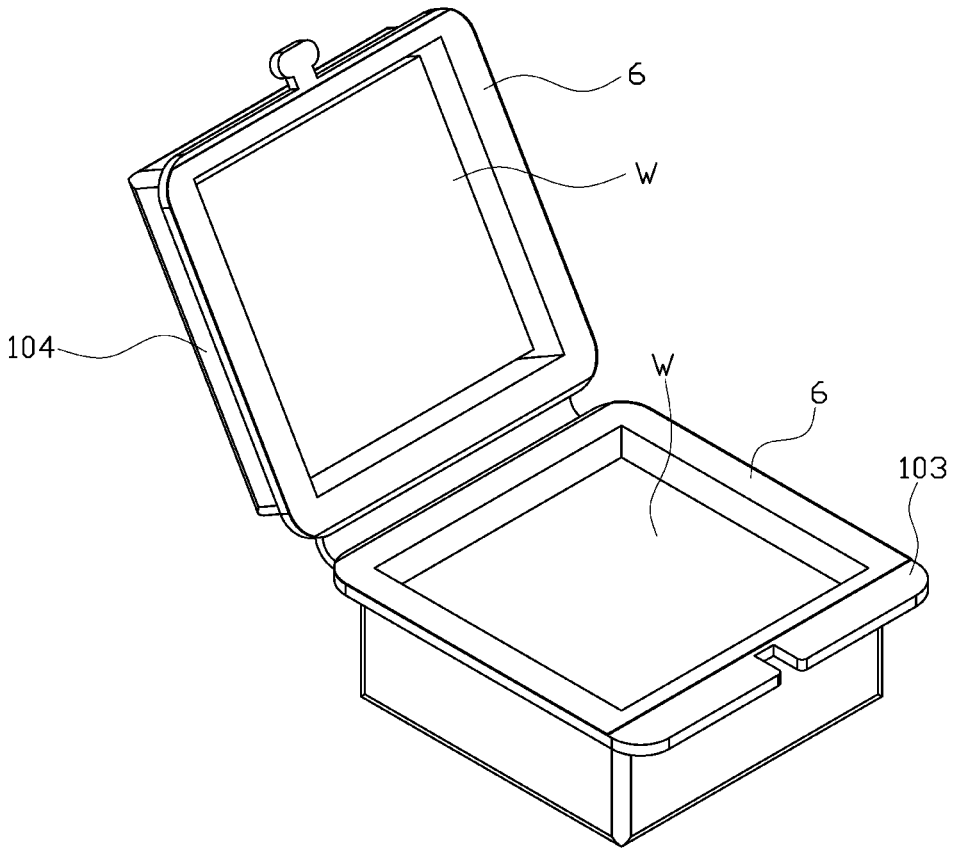
FIG. 12 is a perspective view illustrating a blister pack according to one or more embodiments of the present invention.

(c) In the above embodiments, the article W is placed only in the container main body 3. As shown in FIG. 12, however, articles W may be placed in both a container main body 103 and an outer lid portion 104. In this modification, the article W placed in the container main body 103 and the article W placed in the outer lid portion 104 may be different from each other. In this modification, an inner cover film 6 may be mounted to both the container main body 103 and the outer lid portion 104, such as to close the respective openings.

(d) In the above embodiments, the outer lid portion 4 of the blister pack 1 obtained by punching is closed by the closing device. According to a modification, the closing device may be omitted. The outer lid portion 4 may be closed manually.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 . . . blister pack, 2 . . . lidded container, 2F . . . lidded container-corresponding part, 3 . . . container main body, 3F . . . container-corresponding part, 4 . . . outer lid portion, 6 . . . inner cover film, 6S . . . inner cover scrap portion, 7 . . . container film, 7G . . . scrap mounting portion, 7S . . . container scrap portion, 8S . . . scrap portion, 10 . . . blister packaging machine, 12 . . . heating device, 13 . . . forming device, 14 . . . placing device (placing unit), 17 . . . sealing device (mounting unit), 18 . . . punching device (punching unit), W . . . article

The invention claimed is:

1. A blister packaging machine that manufactures a blister pack, wherein the blister pack comprises:

a lidded container that includes a container main body in which an article is placed and an outer lid portion integrally formed with the container main body, wherein an opening of the container main body is opened and closed by the outer lid portion; and an inner cover film attached to the container main body to close the opening of the container main body in which the article is placed, the blister packaging machine comprising:

a conveyor that conveys a strip-shaped container film in a conveying direction;

a molding device that executes a molding process to the conveyed strip-shaped container film and forms a lidded container-corresponding part corresponding to the lidded container, wherein the lidded container-corresponding part comprises a container part corresponding to the container main body;

a placing device that is disposed downstream of the molding device and places the article in the container part;

a sealing device that is disposed downstream of the placing device and attaches the inner cover film to at least the container part to close an opening of the container part; and a punching device that is disposed downstream of the sealing device and punches out the lidded container-corresponding part along with the inner cover film to produce the blister pack, wherein a scrap portion of the container film and the inner cover film that remains after punching by the punching device is continuous along the conveying direction, wherein the molding device forms, in the container film, the container parts that are arrayed along the conveying direction, the sealing device continuously attaches the inner cover film having a strip shape and extending along the conveying direction to the container parts arrayed along the conveying direction, the scrap portion comprises:

a first scrap portion of the container film that remains after punching by the punching device; and a second scrap portion of the inner cover film that remains after punching by the punching device, wherein the first scrap portion is continuous along the conveying direction, and the second scrap portion is continuous along the conveying direction on one edge side of the inner cover film in a width direction.

2. The blister packaging machine according to claim 1, wherein the sealing device attaches the inner cover film to the container film while keeping a region of the container film corresponding to the first scrap portion and a region of the inner cover film corresponding to the second scrap portion unattached to each other.

3. A blister packaging machine that manufactures a blister pack, wherein the blister pack comprises:

a lidded container that includes a container main body in which an article is placed and an outer lid portion integrally formed with the container main body, wherein an opening of the container main body is opened and closed by the outer lid portion; and an inner cover film attached to the container main body to close the opening of the container main body in which the article is placed, the blister packaging machine comprising:

a conveyor that conveys a strip-shaped container film in a conveying direction;

a molding device that executes a molding process to the conveyed strip-shaped container film and forms a lidded container-corresponding part corresponding to the lidded container, wherein the lidded container-corresponding part comprises a container part corresponding to the container main body;

a placing device that is disposed downstream of the molding device and places the article in the container part;

a sealing device that is disposed downstream of the placing device and attaches the inner cover film to at least the container part to close an opening of the container part; and a punching device that is disposed downstream of the sealing device and punches out the lidded container-corresponding part along with the inner cover film to produce the blister pack, wherein a scrap portion of the container film and the inner cover film that remains after punching by the punching device is continuous along the conveying direction, wherein the molding device forms the container parts at intervals along the conveying direction in the container film, and forms a scrap attaching portion in a region between the adjacent container parts in the container film, wherein the scrap attaching portion is flush in a height direction with a region of the container part to which the inner cover film is attached, the sealing device continuously attaches the inner cover film having a strip shape to the container parts and the scrap attaching portion arranged alternately along the conveying direction, the scrap portion comprises: a first scrap portion of the container film that remains after punching by the punching device; and a second scrap portion of the inner cover film that remains after punching by the punching device, wherein the first scrap portion is continuous along the conveying direction, the scrap attaching portion is located in the first scrap portion, and the second scrap portion is attached to the scrap attaching portion.

4. The blister packaging machine according to claim 3, wherein a width of the strip-shaped inner cover film along a direction perpendicular to the conveying direction is equal to a width of a region of the container part to which the inner cover film is attached along the direction perpendicular to the conveying direction.

* * * * *